US012649891B2

(12) United States Patent
Worthington et al.

(10) Patent No.: US 12,649,891 B2
(45) Date of Patent: Jun. 9, 2026

(54) GREASE COMPOSITION

(71) Applicant: SHELL USA, INC., Houston, TX (US)

(72) Inventors: Eduard Alexander Worthington, Amsterdam (NL); Matthias Eggenstein, Hamburg (DE); Alan Richard Wheatley, London (GB); Christian Biewer, Hamburg (DE)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/993,419

(22) PCT Filed: Aug. 2, 2023

(86) PCT No.: PCT/EP2023/071441

§ 371 (c)(1),
(2) Date: Jan. 10, 2025

(87) PCT Pub. No.: WO2024/033188

PCT Pub. Date: Feb. 15, 2024

(65) Prior Publication Data

US 2026/0008976 A1 Jan. 8, 2026

(30) Foreign Application Priority Data

Aug. 8, 2022 (EP) ..... 22189252

(51) Int. Cl.

| | |
|---|---|
| ***C10M 169/02*** | (2006.01) |
| ***C10M 105/60*** | (2006.01) |
| ***C10M 117/02*** | (2006.01) |
| *C10N 40/02* | (2006.01) |
| *C10N 50/10* | (2006.01) |

(52) U.S. Cl.

CPC ..... *C10M 169/02* (2013.01); *C10M 105/60* (2013.01); *C10M 117/02* (2013.01); *C10M 2207/1206* (2013.01); *C10M 2215/041* (2013.01); *C10N 2040/02* (2013.01); *C10N 2050/10* (2013.01)

(58) Field of Classification Search

CPC ..... C10M 169/02; C10M 105/60; C10M 117/02; C10M 2207/1206; C10M 2215/041; C10N 2040/02; C10N 2050/10

See application file for complete search history.

(56) References Cited

U.S. PATENT DOCUMENTS

| | | | | |
|---|---|---|---|---|
| 4,587,025 | A * | 5/1986 | Horodysky ..... | C10L 1/2222 556/148 |
| 9,096,813 | B2 | 8/2015 | Kawamura et al. | |
| 2010/0298187 | A1 | 11/2010 | Germaine et al. | |
| 2019/0382680 | A1 | 12/2019 | Graham et al. | |

FOREIGN PATENT DOCUMENTS

| | | | |
|---|---|---|---|
| CN | 106635348 | A | 5/2017 |
| CN | 109337747 | A | 2/2019 |
| CN | 109337748 | A | 2/2019 |

OTHER PUBLICATIONS

International Search Report and Written Opinion received for PCT Patent Application No. PCT/EP2023/071441, mailed on Nov. 20, 2023, 09 pages.

* cited by examiner

*Primary Examiner* — Taiwo Oladapo
(74) *Attorney, Agent, or Firm* — SHELL USA, INC.

(57) ABSTRACT

A grease composition comprising:

(i) a mineral base oil containing one or more of fatty ammonium carboxylate salts of formula (I), $$R^1X—(R^2)—NH_3^+ \quad n(^-OOCR^3) \qquad (I)$$

wherein $R^1$ is selected from $C_{12}$ to $C_{20}$ saturated or unsaturated, branched or straight-chain hydrocarbyl groups; X is selected from NH, $^+NH_2$ and N—($R^4$)—$NH_3^+$; $R^2$ and $R^4$ are independently selected from $C_2$ to $C_8$ saturated or unsaturated, branched or straight chain hydrocarbyl groups, and may be the same or different; $R^3$ is selected from $C_{12}$ to $C_{26}$ saturated or unsaturated, branched or straight-chain hydrocarbyl groups; and n is 1 or 2; and (ii) a simple lithium soap thickener, wherein said lubricating grease composition is prepared by a process comprising the steps of combining the mineral base oil with the one or more fatty ammonium carboxylate salts of formula (I) and then thickening said base oil fatty ammonium carboxylate salt mixture with the simple lithium soap thickener.

8 Claims, No Drawings

GREASE COMPOSITION

CROSS REFERENCE TO RELATED APPLICATIONS

This is a National stage application of International Application No. PCT/EP2023/071441, filed 2 Aug. 2023, which claims priority of European Application No. 22189252.4 filed 8 Aug. 2022 which is incorporated herein by reference in its entirety.

FIELD OF THE INVENTION

This invention relates to a lubricating grease composition that provides increased bearing life.

BACKGROUND OF THE INVENTION

Bearings are used to support the rotating shafts of wheels, gears, turbines, rotors, etc., throughout almost all industrial areas. To keep a bearing operating smoothly, it must be appropriately lubricated in order to reduce friction, minimize wear and tear on moving parts, and help maintain lower operating temperatures. Providing the correct lubricating composition for a bearing helps to keep machinery in optimum operating condition and extend its useful life.

The lubrication of bearings creates a barrier between the softer material of bearings and the other parts of a machine. This keeps the bearing moving smoothly and prevents wear and tear. However, over time, bearings will inevitably become worn and require replacement. This requires a machine to be taken out of service while maintenance is carried out. It is important to extend the amount of time that a bearing can be used without requiring replacement or major maintenance.

Because of design simplicity, decreased sealing requirements and less need for maintenance, greases are almost universally given first consideration for lubricating ball and roller bearings. Lubricating grease compositions primarily comprise a base oil and a thickener, with suitable additives included, depending on the use and conditions of use.

Many greases are thickened with soaps and these generally fall into two categories. So called "simple" soaps are formed by the reaction of a metal hydroxide (often lithium hydroxide) with a single fatty acid. In order to create complex-thickened grease, a fatty acid is combined with a short chain complexing acid. The acid mixture is then combined with a metallic hydroxide to form a complex thickener. Like simple soaps, "complex" soaps generally require a single metallic hydroxide, such as lithium hydroxide.

Lithium complex greases, such as those disclosed in WO2020139333 and US2010298187, are known to have excellent performance and provide excellent service life when used to lubricate bearings. The use of certain synthetic base oils and base oil mixtures have also been reported to provide greases which support extend bearing life expectancy.

It remains a challenge to increase the life of bearings lubricated with greases based on simple lithium soaps and without the use of synthetic base oils.

SUMMARY OF THE INVENTION

The present invention provides a lubricating grease composition for use in a bearing, said lubricating grease composition comprising:

(i) a mineral base oil containing one or more of fatty ammonium carboxylate salts of formula (I), $$R^1X—(R^2)—NH_3^+ \quad n(^-OOCR^3) \tag{I}$$

wherein $R^1$ is selected from $C_{12}$ to $C_{20}$ saturated or unsaturated, branched or straight-chain hydrocarbyl groups; X is selected from NH, $^+NH_2$ and N—($R^4$)—$NH_3^+$; $R^2$ and $R^4$ are independently selected from $C_2$ to $C_8$ saturated or unsaturated, branched or straight chain hydrocarbyl groups, and may be the same or different; $R^3$ is selected from $C_{12}$ to $C_{26}$ saturated or unsaturated, branched or straight-chain hydrocarbyl groups; and n is 1 or 2; and (ii) a simple lithium soap thickener, wherein said lubricating grease composition is prepared by a process comprising the steps of combining the mineral base oil with the one or more fatty ammonium carboxylate salts of formula (I) and then thickening said base oil fatty ammonium carboxylate salt mixture with the simple lithium soap thickener.

The present invention also provides a process for the production of a lubricating grease composition, said process comprising the steps of:

(i) combining a mineral base oil with one or more fatty ammonium carboxylate salts of formula (I), $$R^1X—(R^2)—NH_3^+ \quad n(^-OOCR^3) \tag{I}$$

wherein $R^1$ is selected from $C_{12}$ to $C_{20}$ saturated or unsaturated, branched or straight-chain hydrocarbyl groups; X is selected from NH, $^+NH_2$ and N—($R^4$)—$NH_3^+$ $R^2$ and $R^4$ are independently selected from $C_2$ to $C_8$ saturated or unsaturated, branched or straight chain hydrocarbyl groups, and may be the same or different; $R^3$ is selected from $C_{12}$ to $C_{26}$ saturated or unsaturated, branched or straight-chain hydrocarbyl groups; and n is 1 or 2, to form a base oil/fatty ammonium carboxylate salt mixture; and (ii) thickening said base oil/fatty ammonium carboxylate salt mixture with a simple lithium soap.

The present invention further provides the use of the inventive grease composition to increase bearing life.

DETAILED DESCRIPTION OF THE INVENTION

The present inventors have developed a grease composition that has been demonstrated to provide a considerable improvement in bearing life, according to the FE09 bearing life test (DIN 51821). The inventive grease is produced by adding an ammonium carboxylate salt to the mineral base oil during a grease manufacturing process. The base oil is then thickened using a simple lithium soap. Advantageously, the inventive lubricating grease composition requires only a simple mineral base oil as well as a simple lithium soap.

The base oil used herein is a mineral base oil Mineral base oils include liquid petroleum oils and solvent-treated or acid-treated mineral lubricating oil of the paraffinic, naphthenic, or mixed paraffinic/naphthenic type which may be further refined by hydrofinishing processes and/or dewaxing. Mineral base oils are Group I, Group II and/or Group III base oils, according to the definitions of American Petroleum Institute (API) categories I, II and III. Such API categories are defined in API Publication 1509, 15th Edition, Appendix E, April 2002.

Suitable base oils have a kinematic viscosity at 40° C. in the range of from 50 to 250 cSt, preferably in the range of from 70 to 220 cSt, even more preferably in the range of from 80 to 120 cSt.

Typically, the amount of base oil, not including the amount of fatty ammonium carboxylate salt, in the grease composition of the present invention is at least 70 wt %, preferably at least 75 wt %, based on the overall weight of the grease composition. Typically, the amount of base oil, not including the amount of fatty ammonium carboxylate salt, in the grease composition is at most 90 wt %, preferably at most 85 wt %, based on the overall weight of the grease composition.

In the grease compositions of the present invention, one or one or more of fatty ammonium carboxylate salts of formula (I), $$R^1X—(R^2)—NH_3^+ \quad n(^-OOCR^3) \tag{I}$$

is combined with the base oil.

$R^1$ is selected from $C_{12}$ to $C_{20}$ saturated or unsaturated, branched or straight-chain hydrocarbyl groups.

X is selected from NH, $^+NH_2$ and N—($R^4$)—$NH_3^+$, with $R^2$ and $R^4$ each independently selected from $C_2$ to Ca saturated or unsaturated, branched or straight chain hydrocarbyl groups. Preferably, $R^2$ and $R^4$ are independently selected from $(CH_2)_m$, wherein m is selected from 2, 3 or 4. Most preferably $R^2$ and $R^4$ are $(CH_2)_3$.

$R^3$ is selected from $C_{12}$ to $C_{26}$ saturated or unsaturated, branched or straight-chain hydrocarbyl groups. Preferably $R^3$ is selected from $C_{16}$ to $C_{24}$, even more preferably $C_{18}$ to $C_{24}$, saturated or unsaturated, branched or straight chain hydrocarbyl groups.

In the grease composition in use, the fatty acid ammonium carboxylate salt may be present as the original salt or it may also be present as the corresponding amide (e.g. the amide of general formula (II)).

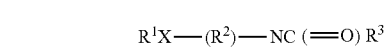

$$R^1X—(R^2)—NC(=O)R^3 \tag{II}$$

That is, wherein, due to the conditions under which the grease is prepared or used, a reaction has happened between the parent amine $R^1X$—($R^2$)—$NH_2$ and the parent acid $R^3COOH$. In some embodiments, further inter- and intramolecular reactions may also occur. In practice, it is likely that a mixture of the fatty acid ammonium carboxylate salt, the amide and any other reaction products will be present in the lubricating grease composition.

In the process of the present invention, the base oil is combined with the fatty ammonium carboxylate salt. Typically, this may be carried out by melting the fatty acid ammonium carboxylate salt, if solid, and mixing it with the base oil. This must be carried out before the base oil is thickened with the simple lithium soap.

The simple lithium soap thickener is produced by the reaction of lithium hydroxide with a fatty acid component. Examples of suitable fatty acid components for preparing the simple lithium soap thickener in the grease composition include hydrogenated castor oil (HCO), hydrogenated castor oil fatty acid (HCOFA), and combinations thereof, preferably hydrogenated castor oil fatty acid (HCOFA). Hydrogenated castor oil (HCO) is the triglyceride of 12-hydroxystearic acid. 12-Hydroxystearic acid is a preferred fatty acid for use herein.

Hydrogenated castor oil fatty acid (referred to herein as HCOFA) generally comprises at least 85 weight percent of 12-hydroxystearic acid based on the total weight of HCOFA. HCOFA may comprise minor amounts of additional components. Examples of additional components include palmitic acid ($C_{16}$), stearic acid (Cia), arachidic acid ($C_{20}$), 12-ketostearic acid, and combinations thereof. As used herein, the term "hydrogenated castor oil fatty acid" ("HCOFA") refers to a composition comprising an amount of 12-hydroxystearic acid, generally an amount comprising at least 85 weight percent 12-hydroxystearic acid based on the total weight of HCOFA, preferably an amount comprising in a range of from 85 to 87 weight percent 12-hydroxystearic acid based on the total weight of HCOFA.

The lithium hydroxide used to produce the lithium soap is preferably present at a level in the range of from 0.5 wt % to 3 wt %, more preferably at a level in the range of from 1 wt % to 3 wt %, by weight of the metal complex grease composition.

The overall content of the simple lithium soap thickener is preferably in the range of from 5 to 15 wt %, more preferably in the range of rom 8 to 13 wt %, on the basis of the overall weight of the grease composition The grease may be thickened with the simple lithium soap thickener using any suitable method. A typical process for the production of a lithium soap thickened grease is described herein for illustration purposes and is not intended to be limiting.

A slurry is prepared in a dedicated slurry tank. This is achieved by adding the solids (e.g. lithium hydroxide) and the liquids (water, base oil(s), additives, etc.) together to prepare a dispersion or "suspension" prior to transfer to an autoclave. The slurry is mixed in a high shear mixer In the present invention, the base oil in the slurry will already contain the fatty ammonium carboxylate salt.

After being thoroughly mixed, the slurry is brought into contact with the fatty acid component in order to effect a saponification reaction. The saponification reaction is carried out at a temperature of at least 80° C., preferably at least 100° C.

At least a portion of, and preferably all of the water is then removed from the product of the saponification reaction. Preferably the water is removed by evaporation in a so-called "venting step". Removal of the water is preferably carried out by heating the product of the saponification reaction to a temperature of at least 100° C., more preferably at least 130° C., even more preferably at least 150° C.

The product is then subjected to a heating step, wherein the is heated to a temperature of at least 190° C., preferably in the range of from 190 to 230° C., more preferably in the range of from 195 to 225° C., and even more preferably in the range of from 200 to 220° C.

The product of the heating step is then subjected to a cooling step. This cooling step is preferably carried out in a grease kettle. Performance additives may be added to the lubricating grease composition. Preferably such additives may be added in the grease kettle.

Various conventional grease additives may be incorporated into the lubricating grease compositions of the present invention, in amounts normally used in this field of application, to impart certain desirable characteristics to the grease, such as oxidation stability, tackiness, extreme pressure properties and corrosion inhibition.

Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine; one or more antirust additives; one or more friction-modifying additives; one or more viscosity-index improving agents; one or more pour point depressing additives; and one or more tackiness agents. Solid materials such as graphite, finely divided molybdenum disulphide, talc, metal powders, calcium carbonates, and various polymers such as polyethylene wax may also be added to impart special properties.

The invention will now be further illustrated by reference to the following non-limiting examples.

EXAMPLES

The present invention will now be explained in greater detail using working examples and comparative examples but is in no way limited to these examples. The raw materials used are as follows. If not explicitly, the quantities shown on the working and comparative examples are as shown in Table 1 below. Moreover, the raw material quantities disclosed in Table 1 (especially those of lithium hydroxide and fatty acids) are the quantities of the reagents. Therefore, the actual quantities of the components in the composition are calculated on the bases of the numerical values shown in Table 1 and the purities given below.

Thickening Agent Raw Materials

- Lithium hydroxide: Special grade, purity 56%
- Hydrogenated castor oil (HCO): Saponification number 180.5 mg/gKOH
- Base Oil A: Paraffin-based mineral oil obtained by dewaxing and solvent refining, group 2 base oil, kinematic viscosity 11.74 $mm^2/s$ at 100° C., viscosity index 107
- Base Oil B: Paraffin-based mineral oil obtain by dewaxing and solvent refining, group 2 base oil, kinematic viscosity 31.56 $mm^2/s$ at 100° C., viscosity index 96
- Base Oil C: Blend of base oil A with 5% m/m of fatty ammonium carboxylate (I)
- Additive A: Overbased calcium alkyl salicylate. Mineral oil content approx. 30%
- Additive B: Alkylmercaptothiadiazole Mineral oil content 25.5%
- Additive C: Sulphurised mixture of highly refined natural triglycerides and natural fatty acid esters
- Additive D: Bismuth naphthenate, naphthenic acid, Mineral oil content 29-31%
- Additive E: 55% Zinc naphthenate in naphthenic base oil, Mineral oil content 45%
- Additive F: Butylated/octylated diphenylamine

Working Example

Base oil C containing 5% of fatty ammonium carboxylate (I) was added to a grease production tank. Hydrogenated castor oil was added, and the mixture was heated to 90° C. to melt the content of the vessel. Afterwards, an appropriate quantity of lithium hydroxide dispersed in water was added to the mixture. Ester cleavage of the hydrogenated castor oil occurs during further heating of the mixture and the grease thickener is formed consecutively while lithium hydroxide and the fatty acids undergo a saponification reaction. The water was evaporated by continued heating to 220° C. while stirring vigorously. The mixture was allowed to cool below 100° C. before the additives A-F were added to the base grease. After addition of the additives the grease cooled to room temperature and a homogenous grease was obtained after shearing the grease with a high-pressure homogenizer.

Comparative Example 1

Base oil A was added to a grease production tank. Following the procedure of the Working Example a homogenous grease was obtained.

Comparative Example 2

Base oil B was added to a grease production tank. Following the procedure of the Working Example a homogenous grease was obtained.

Comparative Example 3

Base oil A was added to a grease production tank. A base grease was made according to the procedure described for the Working Example. After saponification and heating to 220° C. the resulting base grease was cooled below 100° C. The fatty ammonium carboxylate (I) was added before the addition of the additives A-F at a treat rate of 3.89% of the total formulation. Afterwards, the material was sheared with a high-pressure homogenizer to obtain a homogenous grease.

TABLE 1

| | Working Example | Comp Example 1 | Comp Example 2 | Comp Example 3 |
|---|---|---|---|---|
| Thickener content (mass %) | 11.55 | 11.55 | 11.55 | 11.55 |
| Base oil (mass %) | 77.82 | 77.82 | 77.82 | 73.93 |
| Base oil type | C | A | B | A |
| Total additive content A-F (mass %) | 10.63 | 10.63 | 10.63 | 10.63 |

TABLE 1-continued

| | Working Example | Comp Example 1 | Comp Example 2 | Comp Example 3 |
|---|---|---|---|---|
| Penetration (unworked/worked) (1/10 mm)[1] | 293/309 | 291/296 | 335/331 | 248/275 |
| Dropping Point ° C.[2] | 187 | 195 | 193 | 190 |
| Worked Penetration 100.000 strokes (1/10 mm)[1] | 321 | 305 | 345 | 303 |
| Delta Pen 100.000 strokes (1/10 mm)[1] | 12 | 9 | 14 | 28 |
| Worked Pen 10% H2O 100.000 stokes (1/10 mm)[1] | 316 | 323 | 362 | 314 |
| Copper Corrosion 24 h/100° C.[3] | 1b | 1b | 1b | 1b |
| Flow Pressure at −15° C. (mbar)[4] | 475 | 525 | 775 | 800 |
| Roll Stability 18 h/65° C. (1/10 mm)[5] | 304 | 315 | 359 | 297 |
| Delta Pen after roll stability test (1/10 mm)[5] | 5 | 19 | 28 | 22 |
| Oil Bleeding 18 h @40° C. / 7 d@40° C. (%)[6] | 1.9/6.3 | 2.8/7.9 | 2.5/7.9 | 2.2/6.0 |
| EMCOR (distilled water) 1 week (rating)[7] | 0/0 | 0/0 | 0/0 | 0/0 |
| Four Ball Weld Load (kgf/N)[8] | 315/ 3088.9 | 400/ 3922.4 | 400/ 3922.4 | 240/ 3088.9 |
| Four Ball Wear Scar 40 kg, 1 h, 1200 rpm (mm)[9] | 0.567 | 0.622 | 0.643 | 0.67 |
| Fe9 140° C., 6000 rpm, 1500N (h)[10] | F10: 263 F50: 568 | F10: 138 F50: 279 | F10: 105 F50: 148 | F10: 35 F50: 123 |

Test methods used:
[1]ASTM D217;
[2]IP369;
[3]ASTM D4048;
[4]DIN51805;
[5]ASTM D1831;
[6]IP 121;
[7]ASTM D6138;
[8]ASTM D2596;
[9]ASTM D2266;
[10]DIN 51821

Additional information and test data on the abovementioned examples are shown in Table 1. In all examples homogenous greases were obtained and the basic test data provided show similar results for most of the assessed properties. Solely the Working Example for which base oil C, containing 5% of fatty ammonium carboxylate (I), was used showed significant improvement of the roll stability according to ASTM D1831 as well as the bearing life at 140° C. according to DIN 51821. The working Example shows a 103% increase of the bearing life based on the F50 value compared to Comparative Example 1.

However, Comparative Example 3, in which the fatty ammonium carboxylate (I) was added in combination with the other additives A-F toward the end of the process does not show the same benefits. The mode of application described for Comparative Example 3 instead decreases the bearing life by 79% based on the F50 value of Comparative Example 1 without the fatty ammonium carboxylate (I).

We claim:

1. A lubricating grease composition for use in a bearing, said lubricating grease composition comprising:

(i) a mineral base oil containing one or more of fatty ammonium carboxylate salts of formula (I), $$R^1X—(R^2)—NH_3^+ \quad n(^-OOCR^3) \tag{I}$$

wherein $R^1$ is selected from $C_{12}$ to $C_{20}$ saturated or unsaturated, branched or straight-chain hydrocarbyl groups; X is selected from NH, $^+NH_2$ and N—($R^4$)—$NH_3^+$; $R^2$ and $R^4$ are independently selected from $C_2$ to $C_8$ saturated or unsaturated, branched or straight chain hydrocarbyl groups, and may be the same or different; $R^3$ is selected from $C_{12}$ to $C_{26}$ saturated or unsaturated, branched or straight-chain hydrocarbyl groups; and n is 1 or 2; and (ii) a simple lithium soap thickener, wherein said lubricating grease composition is prepared by a process comprising the steps of combining the mineral base oil with the one or more fatty ammonium carboxylate salts of formula (I) and then thickening said base oil fatty ammonium carboxylate salt mixture with the simple lithium soap thickener.

2. The lubricating grease composition as claimed in claim 1, wherein $R^2$ and $R^4$ are independently selected from $(CH_2)_m$, wherein m is selected from 2, 3 or 4.

3. The lubricating grease composition as claimed in claim 1, wherein $R^3$ is selected from $C_{16}$ to $C_{24}$ saturated or unsaturated, branched or straight chain hydrocarbyl groups.

4. The lubricating grease composition as claimed in claim 1, wherein the simple lithium soap thickener is produced by the reaction of lithium hydroxide with a fatty acid component selected from hydrogenated castor oil (HCO), hydrogenated castor oil fatty acid (HCOFA), and combinations thereof.

5. The lubricating grease composition as claimed in claim 1, wherein the overall content of the simple lithium soap thickener is in the range of from 5 to 15 wt %.

6. A process for the production of a lubricating grease composition, said process comprising the steps of:

(i) combining a mineral base oil with one or more fatty ammonium carboxylate salts of formula (I), $$R^1X—(R^2)—NH_3^+ \quad n(^-OOCR^3) \tag{I}$$

wherein $R^1$ is selected from $C_{12}$ to $C_{20}$ saturated or unsaturated, branched or straight-chain hydrocarbyl groups; X is selected from NH, $^+NH_2$ and N—($R^4$)—$NH_3^+$; $R^2$ and $R^4$ are independently selected from $C_2$ to $C_8$ saturated or unsaturated, branched or straight chain hydrocarbyl groups, and may be the same or different; $R^3$ is selected from $C_{12}$ to $C_{26}$ saturated or unsaturated, branched or straight-chain hydrocarbyl groups; and n is 1 or 2; and (ii) thickening said base oil fatty ammonium carboxylate salt mixture with a simple lithium soap.

7. The process as claimed in claim 6, wherein the simple lithium soap thickener is produced by the reaction of lithium hydroxide with a fatty acid component selected from hydrogenated castor oil (HCO), hydrogenated castor oil fatty acid (HCOFA), and combinations thereof.

8. The process as claimed in claim 6, wherein $R^2$ and $R^4$ are independently selected from $(CH_2)_m$, wherein m is selected from 2, 3 or 4; and wherein $R^3$ is selected from $C_{16}$ to $C_{24}$ saturated or unsaturated, branched or straight chain hydrocarbyl groups.

* * * * *